US011263985B2

(12) United States Patent
Chen et al.

(10) Patent No.: US 11,263,985 B2
(45) Date of Patent: Mar. 1, 2022

(54) POWER SUPPLY CIRCUIT AND DISPLAY DEVICE

(71) Applicants: Chongqing BOE Smart Electronics System Co., Ltd., Chongqing (CN); BOE Technology Group Co., Ltd., Beijing (CN)

(72) Inventors: Lichun Chen, Beijing (CN); Bo Liu, Beijing (CN); Yunyan Xie, Beijing (CN)

(73) Assignees: Chongqing BOE Smart Electronics System Co., Ltd., Chongqing (CN); BOE Technology Group Co., LTD., Beijing (CN)

( * ) Notice: Subject to any disclaimer, the term of this patent is extended or adjusted under 35 U.S.C. 154(b) by 0 days.

(21) Appl. No.: 16/957,141

(22) PCT Filed: Dec. 18, 2019

(86) PCT No.: PCT/CN2019/126176
§ 371 (c)(1),
(2) Date: Jun. 23, 2020

(87) PCT Pub. No.: WO2020/140753
PCT Pub. Date: Jul. 9, 2020

(65) Prior Publication Data

US 2021/0225294 A1 Jul. 22, 2021

(30) Foreign Application Priority Data

Jan. 2, 2019 (CN) ..... 201910001220.9

(51) Int. Cl.
*G09G 3/34* (2006.01)

(52) U.S. Cl.
CPC ..... *G09G 3/344* (2013.01); *G09G 2330/028* (2013.01); *G09G 2380/04* (2013.01)

(58) Field of Classification Search
CPC ..... G09G 3/344; G09G 2330/028; G09G 2380/04; H05B 41/2881; H05B 41/2886
See application file for complete search history.

(56) References Cited

U.S. PATENT DOCUMENTS 5,055,747 A * 10/1991 Johns ..... H05B 41/2855 315/307
6,870,462 B1 3/2005 Andersson
(Continued)

FOREIGN PATENT DOCUMENTS

CN 201045457 Y 4/2008
CN 101578061 A 11/2009
(Continued)

OTHER PUBLICATIONS

International search report of PCT application No. PCT/CN2019/126176 dated Mar. 19, 2020.
(Continued)

*Primary Examiner* — Mihir K Rayan
(74) *Attorney, Agent, or Firm* — Fay Sharpe LLP

(57) ABSTRACT

A power supply circuit and a display device are provided, belonging to the field of display technologies. The power supply circuit includes a boosting sub-circuit and a driving sub-circuit. The boosting sub-circuit may boost the voltage of the power signal provided by the power source; the driving sub-circuit may drive the load to work normally while ensuring that the capacitance of the capacitor in the driving sub-circuit is small when supplying power to the load with the power signal of which the voltage is boosted.

18 Claims, 2 Drawing Sheets

(56) References Cited

U.S. PATENT DOCUMENTS

| | | | | |
|---|---|---|---|---|
| 2005/0057181 | A1* | 3/2005 | Izumi | H05B 41/2881 315/209 R |
| 2005/0134461 | A1* | 6/2005 | Gelbman | G06K 17/00 340/572.8 |
| 2006/0284864 | A1* | 12/2006 | Woo | G09G 3/00 345/211 |
| 2007/0030244 | A1* | 2/2007 | Ishii | G09G 3/344 345/107 |
| 2009/0146931 | A1* | 6/2009 | Kharrati | G06F 3/1446 345/82 |
| 2010/0253472 | A1 | 10/2010 | Hashiguchi et al. | |
| 2014/0063411 | A1* | 3/2014 | Takahashi | G09G 3/3406 349/61 |
| 2014/0292107 | A1 | 10/2014 | Cho et al. | |

FOREIGN PATENT DOCUMENTS

| | | | |
|---|---|---|---|
| CN | 202587483 | U | 12/2012 |
| CN | 104102940 | A | 10/2014 |
| CN | 206115471 | U | 4/2017 |
| CN | 109523959 | A | 3/2019 |

OTHER PUBLICATIONS

First office action of Chinese application No. 201910001220.9 dated Dec. 18, 2019.

* cited by examiner

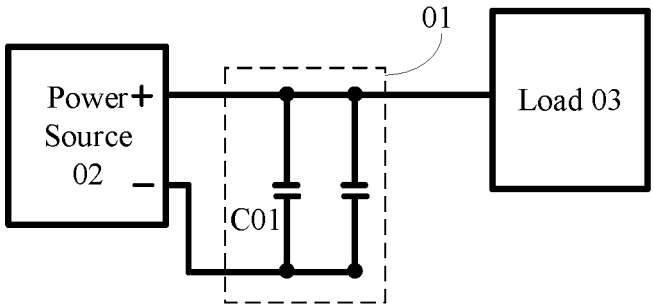
--Prior Art-- FIG. 1
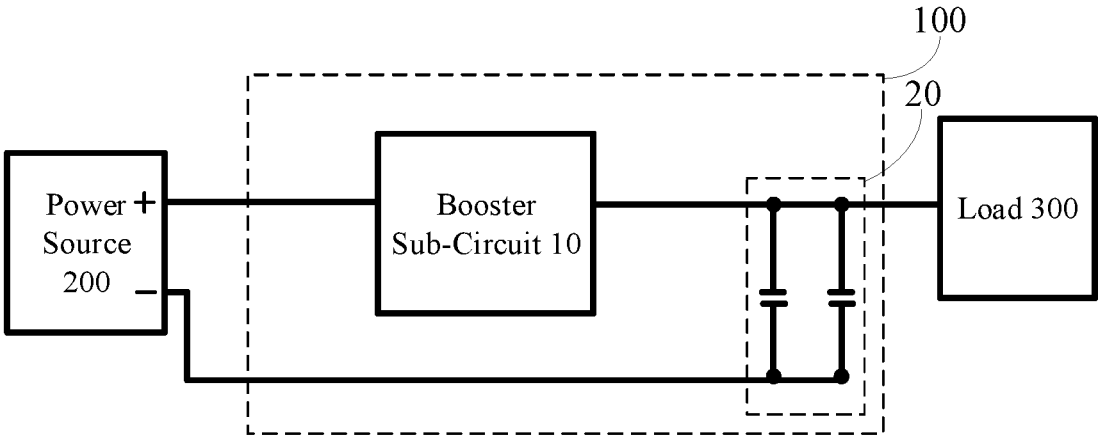
FIG. 2

POWER SUPPLY CIRCUIT AND DISPLAY DEVICE

The present application is a 371 of PCT Application No. PCT/CN2019/126176, filed on Dec. 18, 2019, which claims priority to Chinese Patent Application No. 201910001220.9, filed on Jan. 2, 2019 and entitled by "POWER SUPPLY CIRCUIT AND DISPLAY DEVICE", the entire contents of which are incorporated by reference.

TECHNICAL FIELD

The present disclosure relates to the field of display technologies, and in particular, to a power supply circuit and a display device.

BACKGROUND

An electronic shelf label is an electronic display device with information sending and receiving functions, which is mainly used in supermarkets, convenience stores, and pharmacies. It is an electronic label that can display information such as price, place of origin, and items. This electronic shelf label can quickly and accurately deal with changes in the price of goods, reduces the high cost and time-consuming delays caused by manual processing of traditional paper shelf labels, and greatly reduces the workload and reduces operating costs.

Current electronic shelf labels usually include: power source, power supply circuit and display screen. The power supply circuit usually includes capacitors, by which the electrical signal provided by the power source can be filtered to reduce the ripple voltage in the electrical signal provided by the power source, such that the electrical signal filtered by the capacitors can drive the display to work.

SUMMARY

Embodiments of the present disclosure provide a power supply circuit and a display device. The technical solutions are as follows:

In one aspect, a power supply circuit is provided. The power supply circuit includes a boosting sub-circuit and a driving sub-circuit;

an input terminal of the boosting sub-circuit is used to be connected to a power source, an output terminal of the boosting sub-circuit is connected to the driving sub-circuit, and the driving sub-circuit is used to be connected to a load;

wherein the boosting sub-circuit is used to boost a voltage of a power signal provided by the power source, and transmit the power signal with a boosted voltage to the driving sub-circuit;

the driving sub-circuit is used to supply power to the load.

Optionally, the boosting sub-circuit includes an energy storage device, a control device and a booster switch; an input terminal of the energy storage device is used to be connected to the power source, and an output terminal of the energy storage device is connected to the driving sub-circuit;

a first terminal of the booster switch is connected to an output terminal of the control device, a second terminal of the booster switch is connected to an output terminal of the energy storage device, and a third terminal of the booster switch is connected to a reference power terminal;

wherein the control device is used to control a turn-on or turn-off between the second terminal and the third terminal of the booster switch, the energy storage device stores an energy based on the power signal provided by the power source when the second terminal of the booster switch is in conduction with the third terminal thereof, and the energy storage device releases the stored energy when the second terminal of the booster switch is not in conduction with the third terminal thereof.

Optionally, the energy storage device is an inductor.

Optionally, the boosting sub-circuit includes a switch transistor;

a gate electrode of the switch transistor is connected to the output terminal of the control device, a first electrode of the switch transistor is connected to the output terminal of the energy storage device, and a second electrode of the switch transistor is connected to the reference power terminal.

Optionally, the switch transistor is a metal-oxide-semiconductor transistor.

Optionally, the control device is used to send a pulse width modulated PWM signal to the booster switch;

wherein when the PWM signal is at a first potential, the switch transistor is turned on; when the PWM signal is at a second potential, the switch transistor is turned off.

Optionally, the control device is a microcontroller unit.

Optionally, the boosting sub-circuit further includes a diode; an input terminal of the diode is connected to the output terminal of the energy storage device, and an output terminal of the diode is connected to the driving sub-circuit.

Optionally, the boosting sub-circuit further includes a first feedback resistance and a second feedback resistance;

a first terminal of the first feedback resistance is connected to the driving sub-circuit, and a second terminal of the first feedback resistance is connected to the third terminal of the booster switch and a feedback terminal of the control device respectively, a first terminal of the second feedback resistance is connected to the third terminal of the booster switch and the feedback terminal of the control device respectively, and a second terminal of the second feedback resistance is connected to the reference power terminal.

Optionally, the boosting sub-circuit further includes a protective resistance, a first terminal of the protective resistance is connected to the output terminal of the control device, and a second terminal of the protective resistance is connected to the first terminal of the booster switch.

Optionally, the driving sub-circuit includes a first capacitor and a second capacitor that are connected in parallel;

one terminal of the first capacitor and the second capacitor that are connected in parallel is connected to the output terminal of the boosting sub-circuit and the load respectively, and the other terminal of the first capacitor and the second capacitor that are connected in parallel is connected to the power source.

Optionally, both the first capacitor and the second capacitor are ceramic chip capacitors.

Optionally, the third capacitor has a capacitance of 4.7 microfarads, and the fourth capacitor has a capacitance of 100 nanofarads.

Optionally, the power supply circuit further includes a filter sub-circuit;

the filter sub-circuit is connected between the power source and the input terminal of the boosting sub-circuit, and the filter sub-circuit is used to filter the power signal provided by the power source and transmit the filtered power signal to the boosting sub-circuit.

Optionally, the filter sub-circuit includes a third capacitor and a fourth capacitor, and both the third capacitor and the fourth capacitor are connected in parallel with the power source.

Optionally, the third capacitor has a capacitance of 4.7 microfarads, and the fourth capacitor has a capacitance of 100 nanofarads.

Optionally, one terminal of the inductor is connected to a positive electrode of the power source, and the other end of the inductor is connected to a first node;

a gate electrode of the switch transistor is connected to a second terminal of the protective resistance, a first electrode of the switch transistor is connected to the first node, and a second electrode of the switch transistor is connected to a second node;

the input terminal of the diode is connected to the first node, the output terminal of the diode is connected to a third node, and the third node is used to be connected to the load;

the first terminal of the first feedback resistance is connected to the third node, and the second terminal of the first feedback resistance is connected to the second node; the first terminal of the second feedback resistance is connected to the second node, and the second terminal of the second feedback resistance is connected to the reference power terminal;

the first terminal of the protective resistance is connected to an output terminal of the microcontroller unit, and a feedback terminal of the microcontroller unit is connected to the second node;

one terminal of each of the first capacitor and the second capacitor is connected to the third node, and the other terminal thereof is connected to a negative electrode of the power source;

one terminal of each of the third capacitor and the fourth capacitor is connected to the positive electrode of the power source, and the other terminal thereof is connected to the negative electrode of the power source.

In another aspect, a display device is provided. The display device includes a power source, a load and a power supply circuit, the power supply circuit being the power supply circuit according to the aforesaid aspects.

Optionally, the load is an electrophoretic display.

Optionally, the display device is an electronic shelf label, and the power source is a button battery or a dry battery.

BRIEF DESCRIPTION OF THE DRAWINGS

FIG. 1 is a circuit diagram of a power supply circuit for an electronic shelf label provided by related arts;

FIG. 2 is a circuit diagram of a power supply circuit provided by an embodiment of the present disclosure;

DETAILED DESCRIPTION

Figure 3:
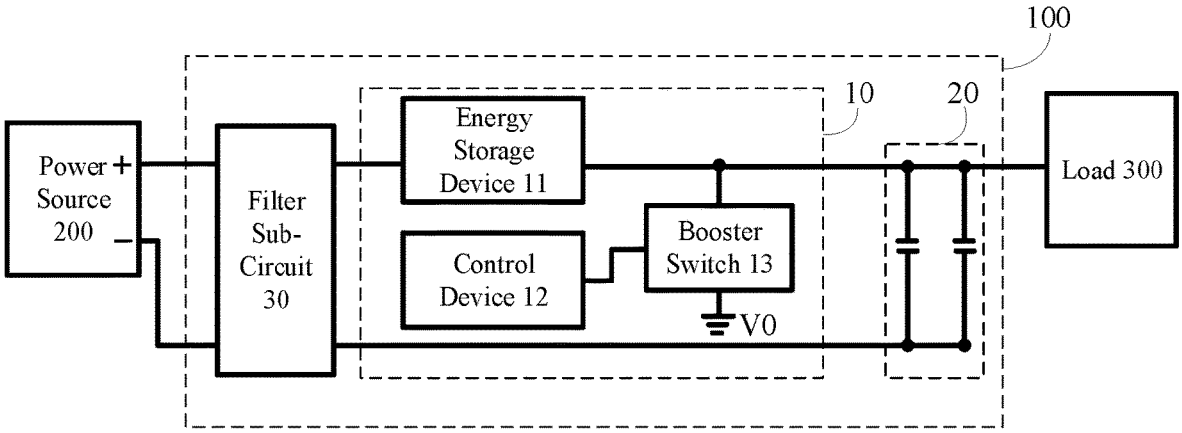
FIG. 3 is a circuit diagram of another power supply circuit provided by an embodiment of the present disclosure.

For clearer descriptions of the objects, technical solutions and advantages in the embodiments of the present disclosure, the present disclosure is described in detail below in combination with the accompanying drawings.

The display screen in an electronic shelf label is usually an electrophoretic display device (EPD). In the low temperature, the particles in the EPD are inert. At this time, the EPD requires a large current to be driven to work normally, so it is necessary to ensure that the capacitance of the capacitor in the power supply circuit is large. With reference to FIG. 1, FIG. 1 is a circuit diagram of a power supply circuit for an electronic shelf label provided by related arts. An input terminal of the power supply circuit 01 is connected to a power source 02 in the electronic shelf label, and an output terminal of the power supply circuit 01 is connected to a load 03 in the electronic shelf label. The load 03 is an electrophoretic display device.

The power supply circuit 01 includes a capacitor C01, and the capacitor C01 may filter the electrical signal provided by the power source 02, thereby reducing a ripple voltage in the electrical signal provided by the power source 02, so that the electric signal filtered by the capacitor C01 may drive the load 03 to work.

When using electronic shelf labels in low-temperature environments such as cake shops or fresh food stores, the particles in the electrophoretic display in the electronic shelf label are inert, and the electrophoretic display requires a large driving current to work properly. At this time, it is necessary to ensure that the capacitance of the capacitor C01 in the power supply circuit 01 is large. The capacitor C01 is usually a farad-level capacitor, for example, the capacitance of the capacitor C01 is 4.7 F (Farad).

However, the volume of this Farad-level capacitor is larger, which results in a larger electronic shelf label. And, the price of the Farad-level capacitor is higher, resulting in higher cost of the electronic shelf label.

With reference to FIG. 2, FIG. 2 is a circuit diagram of a power supply circuit provided by an embodiment of the present disclosure. In an embodiment of the present disclosure, the power supply circuit may supply power to the load in the display device, and the display device may be an electronic shelf label. The power supply circuit 100 may include a boosting sub-circuit 10 and a driving sub-circuit 20.

An input terminal of the boosting sub-circuit 10 is used to be connected to a power source 200, an output terminal of the boosting sub-circuit 10 is connected to the driving sub-circuit 20, and the driving sub-circuit 20 is used to be connected to a load 300. Both the power source 200 and the load 300 may be provided in a display device. The power source 200 may be a button battery or a dry battery. The load 300 may be a display screen. For example, the load 300 may be an electrophoretic display.

Wherein, the boosting sub-circuit 10 is used to boost a voltage of a power signal provided by the power source 200, and transmit the power signal with a boosted voltage to the driving sub-circuit 20. The driving sub-circuit 20 is used to supply power to the load 300.

Illustratively, the boosting sub-circuit 10 has a first state and a second state. The boosting sub-circuit 10 may store an energy based on the electrical signal provided by the power source 200 when being at the first state. The boosting sub-circuit 10 may also release the stored energy when being at the second state. At this time, the energy stored by the boosting sub-circuit 10 may be transmitted to the driving sub-circuit 20 in the form of electrical signal. Meanwhile, the electrical signal provided by the power source 200 may also be transmitted to the driving sub-circuit 20. Therefore, a voltage of the power signal provided by the power source 200 may be boosted by the boosting sub-circuit 10.

The driving sub-circuit 20 may drive the load 300 to work normally while ensuring that the capacitance of the capacitor in the driving sub-circuit 20 is small when supplying power to the load 300 with the power signal of which the voltage is boosted.

In an embodiment of the present disclosure, the capacitor in the driving sub-circuit 20 may be a microfarad-level capacitor, for example, the capacitance of the capacitor is 4.7 microfarad (μF). Thus, the volume of this microfarad-level capacitor is much smaller than the volume of a farad-level capacitor, while the volume of the boosting sub-circuit 10 is usually smaller than the volume of the capacitor, which effectively reduces the volume of the power supply circuit, thereby reducing the volume of the display device. And, the price of the microfarad-level capacitor is relatively low, which effectively reduces the manufacturing cost of the display device.

In summary, the power supply circuit provided by the embodiment of the present disclosure includes a boosting sub-circuit and a driving sub-circuit. The boosting sub-circuit may boost the voltage of the power signal provided by the power source; the driving sub-circuit may drive the load to work normally while ensuring that the capacitance of the capacitor in the driving sub-circuit is small when supplying power to the load with the power signal of which the voltage is boosted. The capacitor with a smaller capacitance is smaller in volume and price, which effectively reduces the volume of the power supply circuit, thereby reducing the volume of the display device and the manufacturing cost of the display device.

With reference to FIG. 3, FIG. 3 is a circuit diagram of another power supply circuit provided by an embodiment of the present disclosure. The power supply circuit 100 may further include a filter sub-circuit 30. The power source 200 may also be connected to the boosting sub-circuit 10 through the filter sub-circuit 30. Illustratively, an input terminal of the filter sub-circuit 30 may be connected to the power source 200, and an output terminal of the filter sub-circuit 30 may be connected to the boosting sub-circuit 10.

Wherein, the filter sub-circuit 30 is used to filter the power signal provided by the power source 200 and transmit the filtered power signal to the boosting sub-circuit 10.

In an embodiment of the present disclosure, the boosting sub-circuit 10 may generally boost a voltage of an electrical signal of a direct current, and the power signal provided by the power source 200 usually contains an AC component. Therefore, in order to enable the boosting sub-circuit 10 to smoothly boost the voltage of the electrical signal, the power signal provided by the power source 200 may be filtered by the filter sub-circuit 30, thereby reducing the ripple voltage of the power signal provided by the power source 200, so that the voltage of the filtered power signal may be boosted by the boosting sub-circuit 10.

Optionally, as shown in FIG. 3, the boosting sub-circuit 10 may include an energy storage device 11, a control device 12 and a booster switch 13.

An input terminal of the energy storage device 11 is connected to the power source 200. In an embodiment of the present disclosure, the input terminal of the energy storage device 11 may be connected to the power source 200 by being connected to the filter sub-circuit 30. An output terminal of the energy storage device is connected to the driving sub-circuit 20.

A first terminal of the booster switch 13 is connected to an output terminal of the control device 12, a second terminal of the booster switch 13 is connected to the output terminal of the energy storage device 11, and a third terminal of the booster switch 13 is connected to a reference power terminal VO. In an embodiment of the present disclosure, the reference power terminal VO may be a low-level power terminal or a ground terminal. It should be noted that FIG. 2 is schematically illustrated by taking that reference power source terminal VO is the ground terminal as an example.

Wherein, the control device 12 is used to control a turn-on or turn-off between the second terminal and the third terminal of the booster switch 13, and the energy storage device 11 stores an energy based on the power signal filtered by the filter sub-circuit 30 when the second terminal of the booster switch 13 is in conduction with the third terminal thereof. The energy storage device 11 releases the stored energy when the second terminal of the booster switch 13 is not in conduction with the third terminal thereof.

Figure 4:
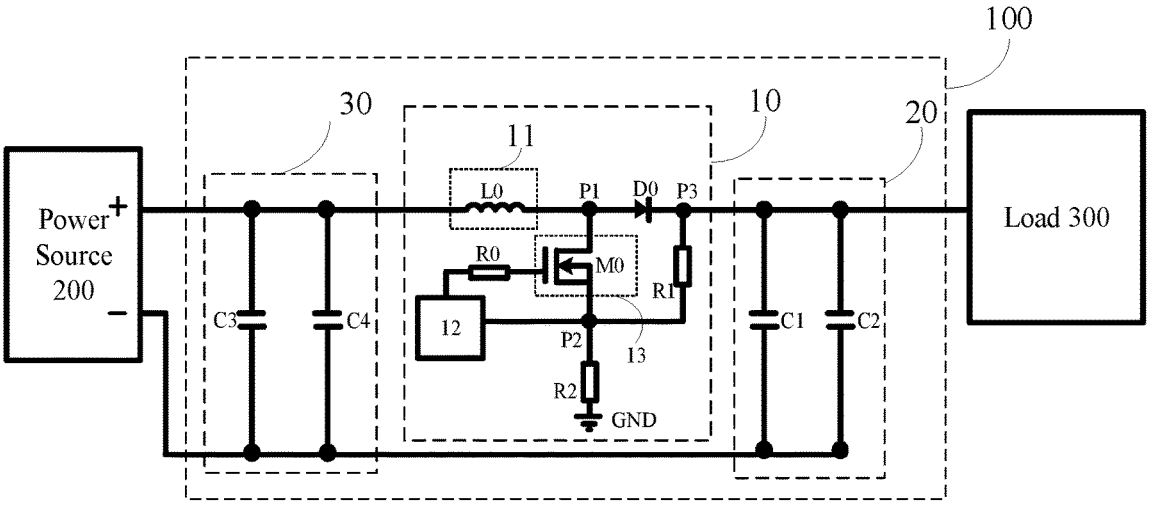
FIG. 4 is a circuit diagram of a still another power supply circuit provided by an embodiment of the present disclosure.

Optionally, as shown in FIG. 4, the energy storage device 11 is an inductor LO. One end of the inductor LO is connected to a positive electrode of the power source 200 as the input terminal of the energy storage device 11, and the other end of the inductor LO is connected to a first node P1 as the output terminal of the energy storage device 11. When the booster switch 13 is turned on, the inductor LO may convert an electrical energy provided by the power signal filtered by the filter sub-circuit 30 into a magnetic energy, and store the magnetic energy. When the booster switch 13 is turned off, the inductor LO may convert an internally-stored magnetic energy into the electrical energy, and transmit the converted electrical energy to the driving sub-circuit 20 in the form of the electrical signal.

Optionally, the control device 12 may be a microcontroller unit (MCU).

From FIG. 4, it can be seen that the booster switch 13 may include a switch transistor MO, and the switch transistor MO may be a metal-oxide-semiconductor (MOS) transistor. A gate electrode of the MOS transistor MO, as the first terminal of the booster switch 13, may be connected to the output terminal of the control device 12; a first electrode of the MOS transistor MO, as the second terminal of the booster switch 13, may be connected to the output terminal of the energy storage device 11, i.e., connected to the first node P1; a second electrode of the MOS transistor MO, as the third terminal of the booster switch 13, may be connected to a reference power terminal VO.

Wherein, the first electrode and the second electrode of the MOS transistor MO may be one of a source electrode and a drain electrode, respectively. For example, the first electrode may be the source electrode and the second electrode may be the drain electrode.

In an embodiment of the present disclosure, the output terminal of the control device 12 may be used to send a pulse width modulation (PWM) signal to the booster switch 13 (for example, the gate electrode of the MOS transistor MO) to control the turn-on or turn-off of the MOS transistor MO.

For example, when the PWM signal is at a first potential, the MOS transistor MO is turned on; when the PWM signal is at a second potential, the MOS transistor MO is in turned off. It should be noted that the PWM signal is usually a square wave signal, the first potential is usually a potential of a high-level signal in the PWM signal, and the second potential is usually a potential of a low-level signal in the PWM signal. When the gate terminal of the MOS transistor MO receives the high-level signal in the PWM signal, the MOS transistor MO may be turned on; when the gate terminal of the MOS transistor MO receives the low-level signal in the PWM signal, the MOS transistor MO may be turned off.

In an embodiment of the present disclosure, as shown in FIG. 4, the boosting sub-circuit 10 may further include a diode DO. An input terminal of the diode DO is connected to the output terminal of the energy storage device 11, and an output terminal of the diode DO is connected to the driving sub-circuit 20. For example, the input terminal of the diode DO is connected to the first node P1, and the output terminal thereof is connected to a third node P3.

Since the diode DO has one-way conductivity, the energy storage device 11 and the filter sub-circuit 30 may input electric signals to the driving sub-circuit 20 through the diode DO when the second terminal of the booster switch 13 is not in conduction with the third terminal thereof. When the second terminal of the booster switch 13 is in conduction with the third terminal thereof, the diode DO is turned off, and the diode DO may prevent the electrical signal output by the driving sub-circuit 20 from affecting the energy storage process of the energy storage device 11.

In an optional implementation, the output terminal of the control device 12 may output electrical signals, by which the turn-on or turn-off between the second terminal and the third terminal of the booster switch 13 may be controlled. As shown in FIG. 4, the boosting sub-circuit 10 may further include a protective resistance R0. A first terminal of the protective resistance R0 is connected to the output terminal of the control device 12, and a second terminal of the protective resistance R0 is connected to the first terminal (e.g., the gate electrode of the MOS transistor MO) of the booster switch 13.

The protective resistance R0 may divide the voltage of the electrical signal output from the output terminal of the control device 12 to avoid damage to the booster switch 13 due to excessive voltage of the electrical signal output from the output terminal of the control device 12.

In an embodiment of the present disclosure, in order to enable the control device 12 to accurately control the turn-on and turn-off between the second terminal and the third terminal of the booster switch 13, the control device 12 need to monitor the energy stored by the energy storage device 11. Illustratively, the boosting sub-circuit 10 may further include a first feedback resistance R1 and a second feedback resistance R2. A first terminal of the first feedback resistance R1 is connected to the driving sub-circuit 20, e.g., may be connected to the third node P3; a second terminal of the first feedback resistance R1 is connected to the second node P2, and the second node P2 is connected to a feedback terminal of the control device 12. A first terminal of the second feedback resistance R2 is connected to the second node P2, and a second terminal of the second feedback resistance R2 is connected to the reference power terminal VO, i.e., the second terminal of the second feedback resistance R2 is grounded.

When the second terminal of the booster switch 13 is in conduction with the third terminal thereof, the filtered power signal of the filter sub-circuit 30 passes through the energy storage device 11 and the booster switch 13 in sequence, and then flow through the second feedback resistance R2 to the reference power terminal VO. Since the second feedback resistance R2 will divide the voltage of the power signal that has passed through the booster switch 13, the energy stored in the energy storage device 11 during energy storage may be monitored by monitoring the feedback terminal of the control device 12 to monitor the voltage of the second feedback resistance R2.

For example, during energy storage of the energy storage device 11, the voltage of the energy storage device 11 may be gradually boosted, so that the voltage of the second feedback resistance R2 may be gradually decreased. If the voltage of the second feedback resistance R2 monitored by the control device 12 is less than or equal to a first voltage threshold, the control device 12 determines that the energy stored in the energy storage device 11 is saturated; and then, the control device 12 need to control the second terminal of the booster switch 13 to be not in conduction with the third terminal thereof, so that the energy storage device 11 may release the energy.

When the second terminal of the booster switch 13 is not in conduction with the third terminal thereof, the filtered power signal of the filter sub-circuit 30 and the energy released by the energy storage device 11 in the form of electrical signals flow to the driving sub-circuit 20 and the first feedback resistance R1 simultaneously. During energy release of the energy storage device 11, the voltage of the energy storage device 11 may be gradually decreased, so that the voltage of the first feedback resistance R1 may be gradually decreased. If the voltage of the first feedback resistance R1 monitored by the control device 12 is less than or equal to a first voltage threshold, the control device 12 determines that the energy stored in the energy storage device 11 is exhausted; and then, the control device 12 need to control the second terminal of the booster switch 13 to be in conduction with the third terminal thereof, so that the energy storage device 11 may store the energy.

Optionally, as shown in FIG. 4, the driving sub-circuit 20 may include a first capacitor C1 and a second capacitor C2 that are connected in parallel. A first terminal of the first capacitor C1 and the second capacitor C2 that are connected in parallel is connected to the output terminal of the boosting sub-circuit 10 and the load 200 (i.e., connected to the third node P3), respectively, and the other terminal of the first capacitor C1 and the second capacitor C2 that are connected in parallel is connected to the power source 200, e.g., may be connected to the negative electrode of the power source 200.

The first capacitor C1 may filter the power signal of which the voltage output from the boosting sub-circuit 10 is boosted to reduce the ripple voltage of the power signal after the voltage boost, so that the load 300 may be driven to work by the first capacitor C1. The second capacitor C2 may filter high-frequency components in the power signal after the voltage boost.

Optionally, both the first capacitor C1 and the second capacitor C2 may be ceramic chip capacitors. The ceramic chip capacitor has a small volume and a low cost, which may effectively reduce the volume and cost of the power supply circuit.

Optionally, the first capacitor C1 has a capacitance of 4.7 g, and the second capacitor C2 has a capacitance of 100 nF.

In an embodiment of the present disclosure, the filter sub-circuit 30 may include a third capacitor C3 and a fourth capacitor C4, wherein both the third capacitor C3 and the fourth capacitor C4 are connected in parallel with the power source 200. That is, as shown in FIG. 4, in the third capacitor C3 and the fourth capacitor C4, one terminal of each of the capacitors is connected to the positive electrode of the power source 200, and the other terminal thereof is connected to the negative electrode of the power source 200.

The third capacitor C3 may filter the power signal output by the power source 200 to reduce the ripple voltage of the power signal. The fourth capacitor C4 may filter high-frequency components in the power signal.

Optionally, the third capacitor C3 and the fourth capacitor C4 may also be ceramic chip capacitors. The third capacitor C3 may have a capacitance of 4.7 and the fourth capacitor C4 may have a capacitance of 100 nF.

In summary, the power supply circuit provided by the embodiment of the present disclosure includes a boosting sub-circuit and a driving sub-circuit. The boosting sub-circuit may boost the voltage of the power signal provided by the power source; the driving sub-circuit may drive the load to work normally while ensuring that the capacitance of the capacitor in the driving sub-circuit is small when supplying power to the load with the power signal of which the voltage is boosted. The capacitor with a smaller capacitance is smaller in volume and price, which effectively reduces the volume of the power supply circuit, thereby reducing the volume of the display device and the manufacturing cost of the display device.

An embodiment of the present disclosure further provides a display device. With reference to FIGS. 2 to 4, the display device may include a power source 200, a load 300 and a power supply circuit 100. The power supply circuit 100 may be the power supply circuit shown in any one of FIGS. 2 to 4.

Wherein, the load 300 may be a display screen. For example, the load 300 may be an electrophoretic display. The power source 200 may be a button battery or a dry battery.

Optionally, the display device may be an electronic shelf label. When using electronic shelf labels in low-temperature environments such as cake shops or fresh food stores, the particles in the electrophoretic display in the electronic shelf label are inert. Since the power supply circuit in the electronic shelf label includes a boosting sub-circuit and a driving sub-circuit, the boosting sub-circuit may boost the voltage of the power signal provided by the power source, so that the driving sub-circuit may supply power to the electrophoretic display through the boosted power signal. The driving sub-circuit may increase the current input to the electrophoretic display without the need for a capacitor with a large capacitance, thereby effectively reducing the volume of the electronic shelf label and reducing the manufacturing cost of the electronic shelf label.

The foregoing descriptions are merely optional embodiments of the present disclosure, and are not intended to limit the present disclosure. Within the spirit and principles of the present disclosure, any modifications, equivalent substitutions, improvements, etc., are within the protection scope of the present disclosure.

What is claimed is:

1. A power supply circuit used in an electronic shelf label, comprising a boosting sub-circuit and a driving sub-circuit;

an input terminal of the boosting sub-circuit is used to be connected to a power source, an output terminal of the boosting sub-circuit is connected to the driving sub-circuit, and the driving sub-circuit is used to be connected to a load;

wherein the boosting sub-circuit is used to boost a voltage of a power signal provided by the power source, and transmit the power signal with a boosted voltage to the driving sub-circuit;

the driving sub-circuit is used to supply power to the load; and the boosting sub-circuit comprises an energy storage device, a control device, a booster switch, a first feedback resistance and a second feedback resistance; wherein an input terminal of the energy storage device is used to be connected to the power source, and an output terminal of the energy storage device is connected to the driving sub-circuit;

a first terminal of the booster switch is connected to an output terminal of the control device, a second terminal of the booster switch is connected to an output terminal of the energy storage device, and a third terminal of the booster switch is connected to a reference power terminal;

the control device is used to control a conduction state between the second terminal and the third terminal of the booster switch, the energy storage device stores an energy based on the power signal provided by the power source when the second terminal of the booster switch is in conduction with the third terminal of the booster switch, and the energy storage device releases stored energy when the second terminal of the booster switch is not in conduction with the third terminal of the booster switch;

a first terminal of the first feedback resistance is connected to the driving sub-circuit, and a second terminal of the first feedback resistance is connected to the third terminal of the booster switch and a feedback terminal of the control device, respectively; and a first terminal of the second feedback resistance is connected to the third terminal of the booster switch and the feedback terminal of the control device, respectively, and a second terminal of the second feedback resistance is connected to the reference power terminal.

2. The power supply circuit according to claim 1, wherein the energy storage device is an inductor.

3. The power supply circuit according to claim 1, wherein the boosting sub-circuit comprises a switch transistor;

a gate electrode of the switch transistor is connected to the output terminal of the control device, a first electrode of the switch transistor is connected to the output terminal of the energy storage device, and a second electrode of the switch transistor is connected to the reference power terminal, wherein the first electrode and the second electrode are one of a source electrode and a drain electrode, respectively.

4. The power supply circuit according to claim 3, wherein the switch transistor is a metal-oxide-semiconductor transistor.

5. The power supply circuit according to claim 3, wherein the control device is used to send a pulse width modulated PWM signal to the booster switch:

wherein when the PWM signal is at a first potential, the first electrode of the switch transistor is in conduction with the second electrode of the switch transistor; when the PWM signal is at a second potential, the first electrode of the switch transistor is not in conduction with the second electrode of the switch transistor.

6. The power supply circuit according to claim 1, wherein the control device is a microcontroller unit.

7. The power supply circuit according to claim 1, wherein the boosting sub-circuit further comprises a diode;

an input terminal of the diode is connected to the output terminal of the energy storage device, and an output terminal of the diode is connected to the driving sub-circuit.

8. The power supply circuit according to claim 1, wherein the boosting sub-circuit further comprises a protective resistance;

a first terminal of the protective resistance is connected to the output terminal of the control device, and a second terminal of the protective resistance is connected to the first terminal of the booster switch.

9. The power supply circuit according to claim 1, wherein the driving sub-circuit comprises a first capacitor and a second capacitor that are connected in parallel;

one terminal of the first capacitor and the second capacitor that are connected in parallel is connected to the output terminal of the boosting sub-circuit and the load, respectively, and the other terminal of the first capacitor and the second capacitor that are connected in parallel is connected to the power source.

10. The power supply circuit according to claim 9, wherein both the first capacitor and the second capacitor are ceramic chip capacitors.

11. The power supply circuit according to claim 9, wherein the first capacitor has a capacitance of 4.7 microfarads, and the second capacitor has a capacitance of 100 nanofarads.

12. The power supply circuit according to claim 1, wherein the power supply circuit further comprises a filter sub-circuit;

the filter sub-circuit is connected between the power source and the input terminal of the boosting sub-circuit, and the filter sub-circuit is used to filter the power signal provided by the power source and transmit filtered power signal to the boosting sub-circuit.

13. The power supply circuit according to claim 12, wherein the filter sub-circuit comprises a third capacitor and a fourth capacitor, and both the third capacitor and the fourth capacitor are connected in parallel with the power source.

14. The power supply circuit according to claim 13, wherein the third capacitor has a capacitance of 4.7 microfarads, and the fourth capacitor has a capacitance of 100 nanofarads.

15. The power supply circuit according to claim 1, wherein the energy storage device is an inductor, and the control device is a microcontroller unit, the booster switch comprises a switch transistor, and the switch transistor is a metal-oxide-semiconductor transistor; the boosting sub-circuit further comprises a diode, a first feedback resistance, a second feedback resistance and a protective resistance; the driving sub-circuit comprises a first capacitor and a second capacitor that are connected in parallel; and the power supply circuit further comprises a third capacitor and a fourth capacitor that are connected in parallel;

wherein one terminal of the inductor is connected to a positive electrode of the power source, and the other end of the inductor is connected to a first node;

a gate electrode of the switch transistor is connected to a second terminal of the protective resistance, a first electrode of the switch transistor is connected to the first node, and a second electrode of the switch transistor is connected to a second node;

the input terminal of the diode is connected to the first node, the output terminal of the diode is connected to a third node, and the third node is used to be connected to the load;

the first terminal of the first feedback resistance is connected to the third node, and the second terminal of the first feedback resistance is connected to the second node;

the first terminal of the second feedback resistance is connected to the second node, and the second terminal of the second feedback resistance is connected to the reference power terminal;

the first terminal of the protective resistance is connected to an output terminal of the microcontroller unit, and a feedback terminal of the microcontroller unit is connected to the second node;

one terminal of each of the first capacitor and the second capacitor is connected to the third node, and the other terminal thereof is connected to a negative electrode of the power source;

one terminal of each of the third capacitor and the fourth capacitor is connected to the positive electrode of the power source, and the other terminal thereof is connected to the negative electrode of the power source.

16. A display device, comprising a power source, a load and a power supply circuit, the power supply circuit being the power supply circuit according to claim 1.

17. The display device according to claim 16, wherein the load is an electrophoretic display.

18. The display device according to claim 16, wherein the display device is an electronic shelf label, and the power source is one of a button battery and a dry battery.

* * * * *